US007453409B2

(12) United States Patent
Zimmerman et al.

(10) Patent No.: US 7,453,409 B2
(45) Date of Patent: Nov. 18, 2008

(54) LOW PROFILE ANTENNA SYSTEM AND ASSOCIATED METHODS

(75) Inventors: Kurt Alan Zimmerman, Indialantic, FL (US); Robert Francis Meehan, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 381 days.

(21) Appl. No.: 11/324,954

(22) Filed: Jan. 3, 2006

(65) Prior Publication Data

US 2007/0152897 A1 Jul. 5, 2007

(51) Int. Cl.
*H01Q 3/00* (2006.01)

(52) U.S. Cl. ..... 343/765

(58) Field of Classification Search ..... 343/765–766, 343/711–713

See application file for complete search history.

(56) References Cited

U.S. PATENT DOCUMENTS

| | | | | |
|---|---|---|---|---|
| 4,831,384 | A * | 5/1989 | Sefton, Jr. | 342/188 |
| 5,216,431 | A * | 6/1993 | Sinyard et al. | 343/765 |
| 5,575,438 | A | 11/1996 | McGonigle et al. | 244/13 |
| 5,748,151 | A * | 5/1998 | Kingston et al. | 343/753 |
| 5,952,980 | A | 9/1999 | Boling | 343/766 |
| 6,195,060 | B1 | 2/2001 | Spano et al. | 343/766 |
| 6,204,823 | B1 | 3/2001 | Spano et al. | 343/766 |
| 6,285,338 | B1 * | 9/2001 | Bai et al. | 343/882 |
| 6,396,448 | B1 | 5/2002 | Zimmerman et al. | 343/753 |
| 6,400,315 | B1 | 6/2002 | Adler et al. | 342/359 |
| 6,653,981 | B2 | 11/2003 | Wang et al. | 343/713 |
| 6,657,589 | B2 | 12/2003 | Wang et al. | 342/383 |
| 6,937,199 | B2 | 8/2005 | King | 343/757 |
| 2003/0071759 | A1 | 4/2003 | Bien et al. | 343/757 |
| 2003/0080898 | A1 | 5/2003 | Wang et al. | 342/359 |
| 2003/0080907 | A1 | 5/2003 | Wang et al. | 343/713 |
| 2003/0083063 | A1 | 5/2003 | Wang et al. | 455/427 |
| 2004/0246191 | A1 | 12/2004 | Melconian at el. | 343/779 |

FOREIGN PATENT DOCUMENTS

| | | |
|---|---|---|
| EP | 0 520 424 | 12/1992 |

* cited by examiner

*Primary Examiner*—Huedung Mancuso
(74) *Attorney, Agent, or Firm*—Allen, Dyer, Doppelt, Milbrath & Gilchrist, P.A.

(57) ABSTRACT

An antenna system includes a base, a turntable rotatably mounted on the base, and an elevation assembly carried on the turntable. An antenna is carried by the elevation assembly. The turntable has an antenna relief opening therein to permit the elevation assembly to position a lower portion of the antenna therein. The antenna system may further include an RF absorbing shroud carried by the turntable and that has an antenna receiving recess to receive the antenna therein. The antenna receiving recess may have lower portions extending into the antenna relief opening of the turntable.

20 Claims, 4 Drawing Sheets

LOW PROFILE ANTENNA SYSTEM AND ASSOCIATED METHODS

FIELD OF THE INVENTION

The invention relates to the field of communications, and, more particularly, to an antenna system and related methods.

BACKGROUND OF THE INVENTION

An antenna is typically used to capture electromagnetic energy to a receiver when used in a receive mode, and, conversely radiates electromagnetic energy from a transmitter when used in a transmit mode. To achieve this, the antenna needs to be properly positioned. For example, U.S. Pat. No. 6,937,199 to King discloses a parabolic reflector antenna that includes two-axis mechanical scan for positioning the antenna. Azimuthal scanning is provided by a turntable and elevational scanning is provided by an elevation assembly and positioner. In addition, the parabolic reflector has a truncated lower edge to reduce its vertical profile.

A group of related U.S. Pat. Nos. 6,653,981 and 6,657,589, and U.S. Published Application Nos. 2003/0083063; 2003/0080907; 2003/0080898 all to Wang et al. discloses a low profile cylindrical reflector antenna system. The system includes a pair of cylindrical reflector antennas that are scanned in the azimuth direction by a turntable, and in the elevational direction by an elevation assembly and positioner.

A low profile antenna system may be particularly desirable for airborne applications, for example. A particularly advantageous low profile antenna system is disclosed in U.S. Pat. No. 6,204,823 to Spano et al. and assigned to the assignee of the present invention. The patent discloses a phased array antenna with two-axis mechanical scanning. Azimuthal scan is provided by a turntable, and elevational scan is provided by an elevation drive mechanism. Similarly, U.S. Pat. No. 5,952,980 to Boling discloses a low profile antenna positioning system that may include a reflector antenna.

Unfortunately, the conventional low profile reflector antenna positioning systems may still be too large for a number of applications, such as particularly for airborne applications, and hybrid or phased array antennas may add unwanted complexity and cost.

SUMMARY OF THE INVENTION

In view of the foregoing background, it is therefore an object of the invention to provide an antenna system that has a low profile and is relatively straightforward in construction.

This and other objects, features, and advantages in accordance with the invention are provided by an antenna system that may include a base, a turntable rotatably mounted on the base, an elevation assembly carried on the turntable, and an antenna may be carried by the elevation assembly. Moreover, the turntable may have an antenna relief opening therein to permit the elevation assembly to position a lower portion of the at least one antenna therein. Accordingly, the antenna system may have a low profile and may be relatively straightforward in construction.

The antenna system may further include an RF (Radio Frequency) absorbing shroud carried by the turntable and that has an antenna receiving recess to receive the antenna therein. The antenna receiving recess may have lower portions extending into the antenna relief opening of the turntable. As such, the antenna may have a reduced profile due to a capability to scan while the lower portion of the antenna is within the antenna receiving recess of the RF shroud that, in turn, is within the antenna relief opening of the turntable. The RF absorbing shroud may comprise a planar upper portion having the antenna receiving recess therein and support legs depending therefrom to position the planar upper portion above the turntable a sufficient distance so that the at least one antenna remains below the planar upper portion.

The antenna system may further comprise a planar radome adjacent to the RF absorbing shroud. The antenna may comprise a reflector antenna. The reflector antenna may comprise a plurality of side-by-side reflector antennas, for example. The reflector antenna may have truncated upper and lower edge portions in some embodiments. The antenna may also comprise a center feed reflector antenna.

The elevation assembly may comprise an elevation positioner operatively connected between the antenna and the turntable. The turntable may comprise an azimuth positioner operatively connected to the base. The antenna system may further comprise a controller carried by the turntable and cooperating with the elevation positioner and the azimuth positioner.

A method aspect is directed to operating an antenna system comprising a base, a turntable rotatably mounted on the base, an elevation assembly carried on the turntable, at least one antenna carried by the elevation assembly, and with the turntable having an antenna relief opening therein. The method may comprise operating the elevation assembly to position a lower portion of the at least one antenna in the antenna relief opening of the turntable. The method may further comprise providing an RF absorbing shroud to be carried by the turntable and having an antenna receiving recess to receive the antenna therein.

DETAILED DESCRIPTION OF THE PREFERRED EMBODIMENTS

The invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
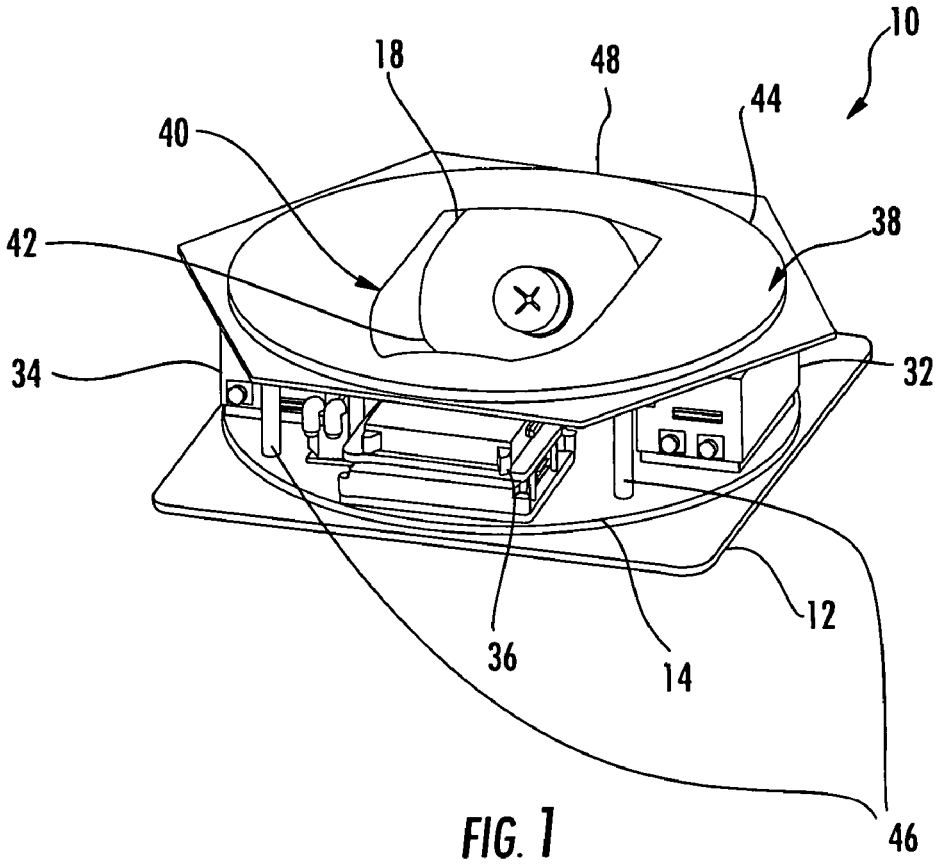
FIG. 1 is a fragmentary front perspective of an antenna system in accordance with the invention.
Figure 3:
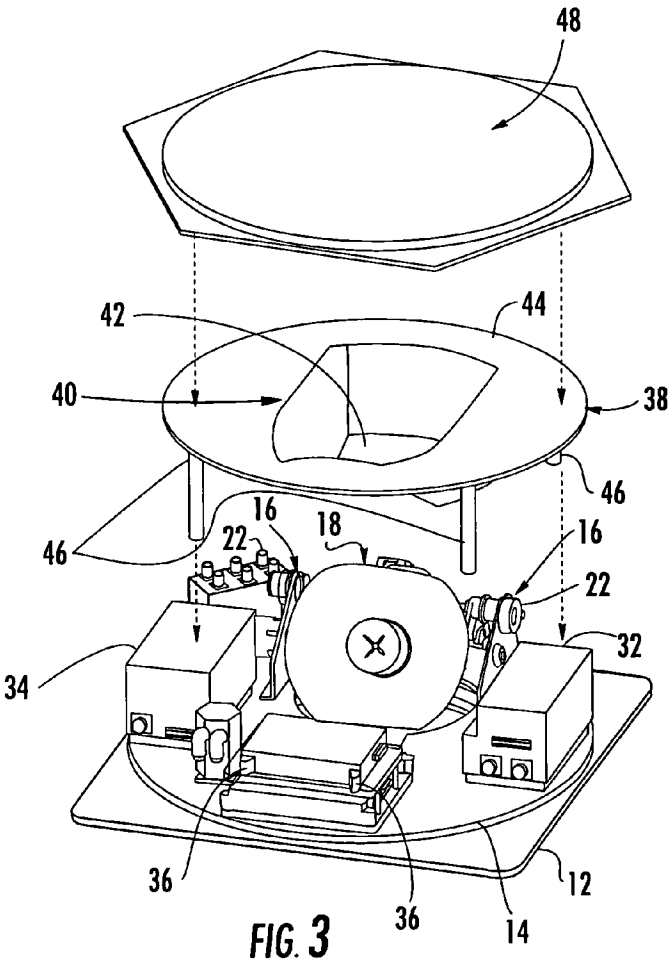
FIG. 3 is an exploded perspective view of the antenna system in FIG. 1.
Figure 2:
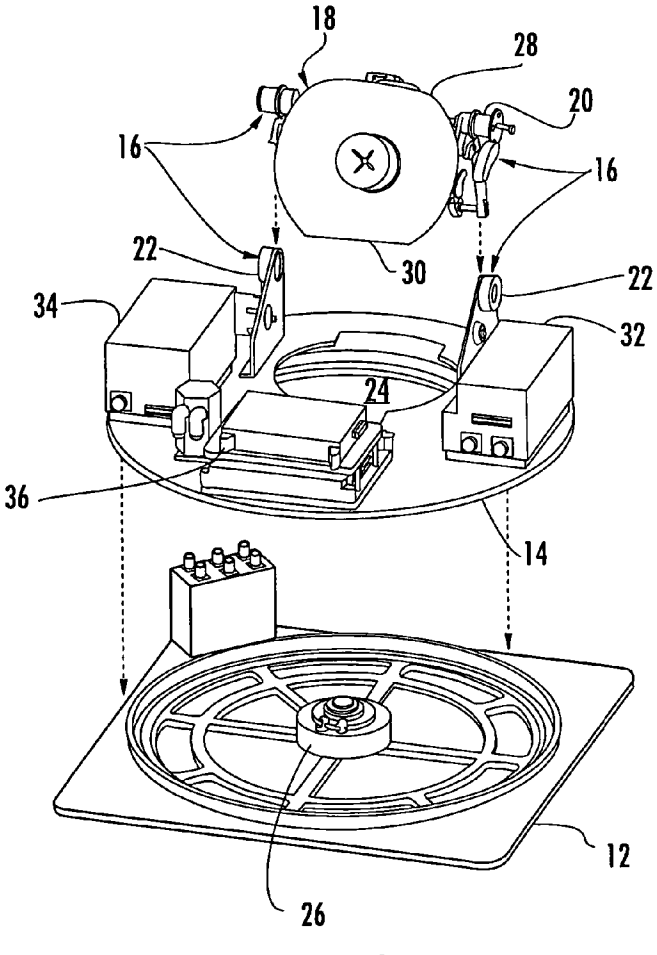
FIG. 2 is an exploded perspective view of a portion of the antenna system in FIG. 1.

Referring initially to FIGS. 1-3, an antenna system 10 in accordance with the invention is now described. The antenna system 10 includes a base 12, a turntable 14 rotatably mounted on the base, and an elevation assembly 16 carried on the turntable. A rotary joint 26 (FIG. 2) provides the rotatable mount between the base 12 and the turntable 14. The rotary joint 26 may comprise a nested RF rotary joint, a slipring rotary joint, a liquid cooling rotary joint, or the like as will be appreciated by those skilled in the art.

An antenna is carried by the elevation assembly 16. The antenna is illustratively in the form of a center fed reflector antenna 18 although, as will be appreciated by those of skill in the art, other types of reflector antennas, non-reflector antennas, phased array antennas, fixed phased array antennas, horn antennas, arrays of horn antennas, horns/lens antennas, hybrid antennas, non-trimmed antennas, elliptical antennas (non-circular), or the like may also be used in other embodiments. The illustrated antenna 18 also has truncated upper and lower edge portions 28, 30 to reduce the profile while permitting a large elevational scanning angle.

The elevation assembly 16 comprises left and right support members 22 connected to the base 12, and left and right mounting stubs 20 extending from opposite sides of the antenna 18 and rotatably supported by the support members as will be appreciated by those of skill in the art. The elevation assembly 16 also includes an elevation positioner 32 operatively connected between the antenna 18 and the turntable 14 for positioning the antenna as will be appreciated by those of skill in the art. The turntable 14 also comprises an azimuth positioner 34 operatively connected to the base for rotatably positioning the turntable in relation to the base 12. The antenna system 10 further illustratively includes a controller 36 carried by the turntable 14 and cooperating with the elevation positioner 32 and the azimuth positioner 34 for controlling each positioner as will be appreciated by those of skill in the art.

The antenna 18 can be positioned at various elevational scan angles by the elevation assembly 16. The turntable 14 illustratively has an antenna relief opening 24 (FIG. 2) therein to permit the elevation assembly 16 to position the lower portion 30 of the antenna 18 therein. Accordingly, because the antenna system 10 permits the antenna 18 to scan while a lower portion 30 of the antenna is below an upper surface of the turntable 14, the antenna system may be more compact than prior art antennas systems.

The antenna system 10 may further advantageously include an RF absorbing shroud 38 carried by the turntable 14. The RF absorbing shroud 38 has an antenna receiving recess 40 to receive the antenna 18 therein (FIG. 1). The RF absorbing shroud 38 permits the antenna 18 to operate with reduced interference to/from extraneous signals as will be appreciated by those of skill in the art.

The antenna receiving recess 40 may have lower portions 42 extending into the antenna relief opening 24 of the turntable 14. As such, the antenna 18 has a reduced operating profile and is able to scan downwardly until the lower portion of the antenna is within the antenna receiving recess 40 that, in turn, is within the antenna relief opening 24. The RF absorbing shroud 38 may comprise a planar upper portion 44 having the antenna receiving recess 40 therein and a plurality of support legs 46 depending therefrom to position the planar upper portion above the turntable 14 at a sufficient distance so that the antenna 18 remains below the planar upper portion. As will be appreciated by those of skill in the art, any number of support legs 46 may be used. The antenna system 10 may further comprise a planar radome 48 adjacent to the RF absorbing shroud 38.

Figure 4:
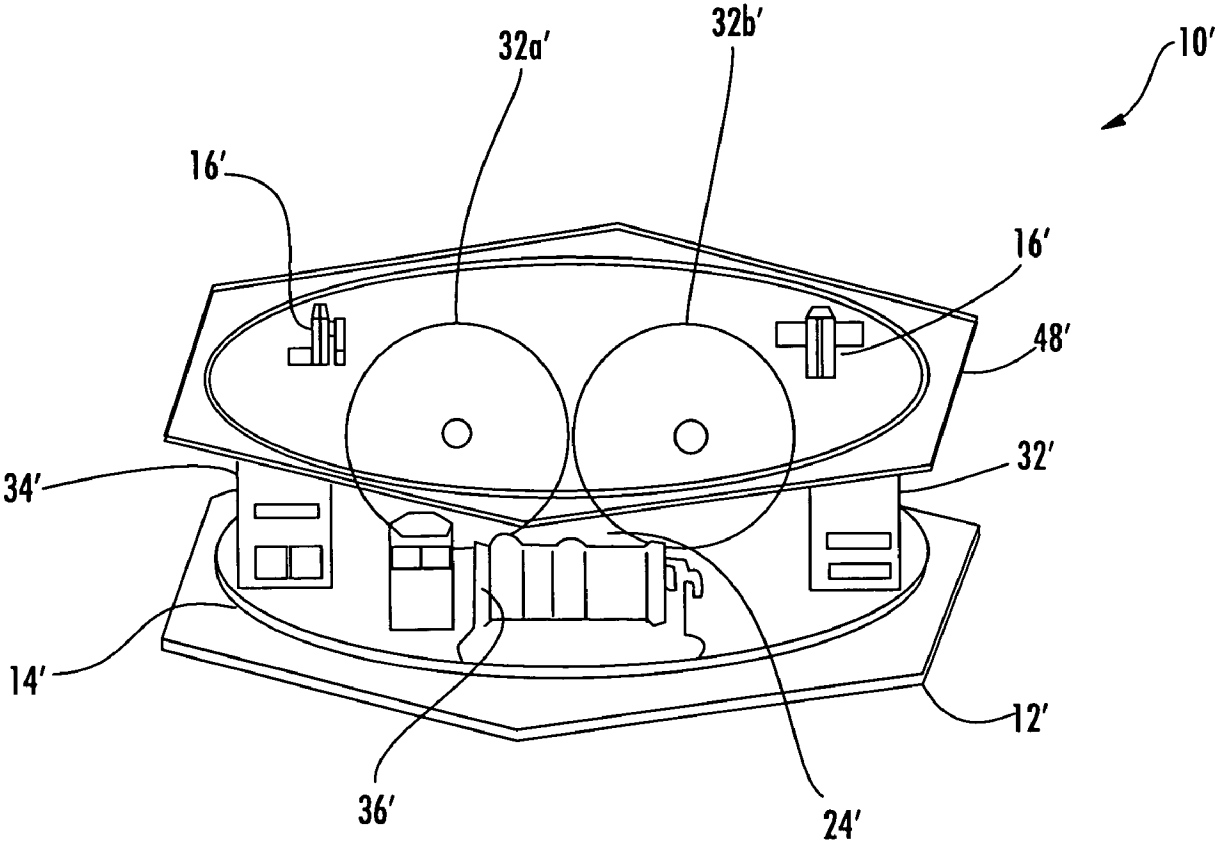
FIG. 4 is a fragmentary front perspective view of another embodiment of the invention.

Referring now additionally to FIG. 4, in another embodiment of an antenna system 10', a pair of side-by-side reflector antennas 32*a*', 32*b*' are provided and positioned so that lower portions thereof extend into an antenna receiving opening in the turntable 14'. Of course, this embodiment of the antenna system 10' may also include an RF shroud as discussed above and as will be appreciated by those skilled in the art.

Figure 7:
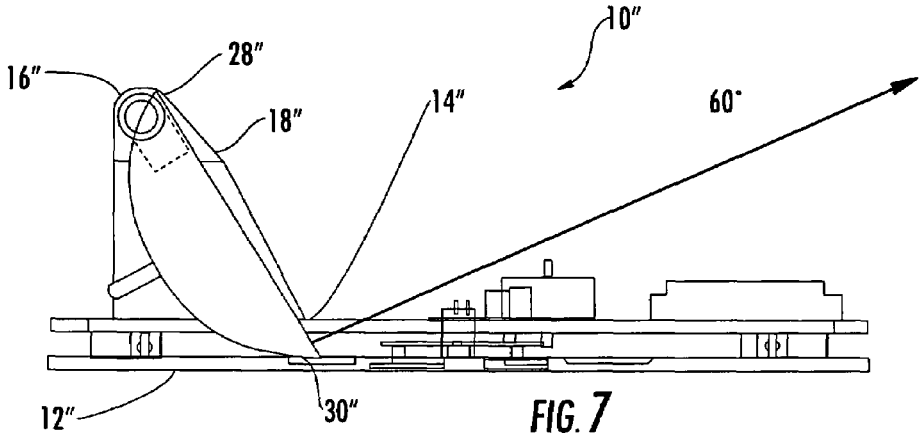
FIGS. 5-7 are side elevations views of portions of yet another embodiment of an antenna system of the invention illustrated at different elevational scan positions.
Figure 6:
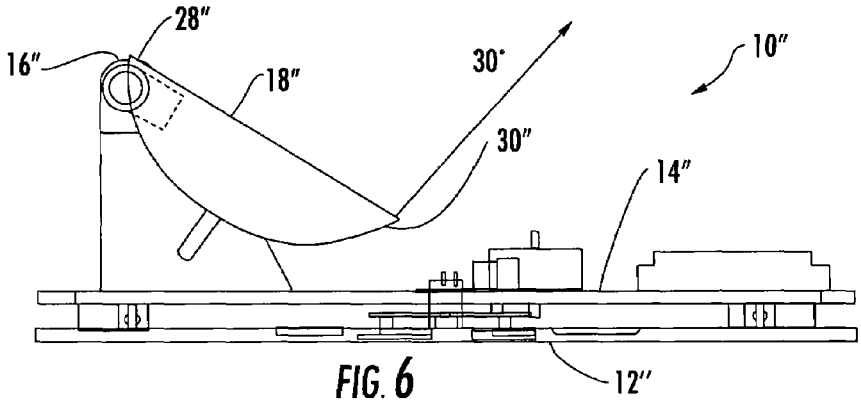
Figure 5:
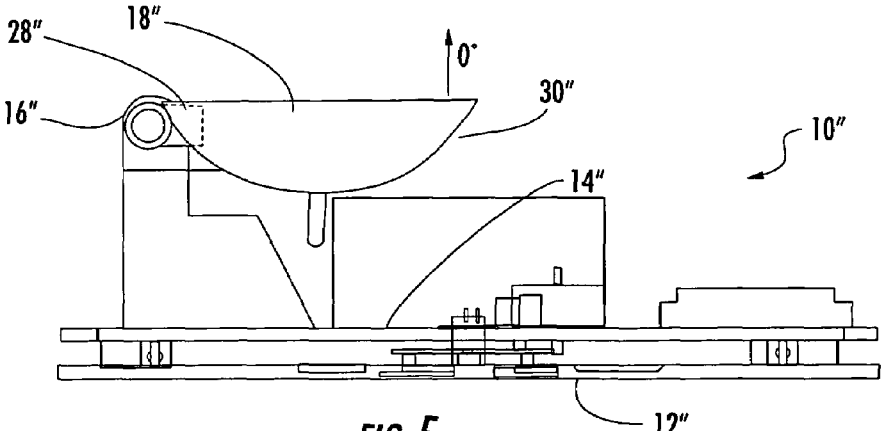

A sequence of elevational scan angles, at 0, 30 and 60 degrees, are illustrated for another embodiment of an antenna system 10" in FIGS. 5-7, respectively. As seen perhaps best in FIG. 7, the lower portions of the antenna 18" extend into the opening of the turntable 14" at the 60 degree pointing position.

Returning again to FIGS. 1-3, a method aspect is directed to operating an antenna system 10 comprising a base 12, a turntable 14 rotatably mounted on the base, an elevation assembly 16 carried on the turntable, at least one antenna 18 carried by the elevation assembly 16, and with the turntable 14 having an antenna relief opening 24 therein. The method may include operating the elevation assembly 16 to position a lower portion 30 of the antenna 18 therein. The method may further comprise providing an RF absorbing shroud 38 to be carried by the turntable 14 and having an antenna receiving recess 40 to receive the antenna 18 therein.

The above described antenna systems provide a compactness and simplicity that is highly desirable in many applications. For example, the antenna systems may be used in a manned or unmanned airborne vehicle. As will be appreciated by those of skill in the art, many other applications would benefit from the use of the antenna systems. Accordingly, many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that other modifications and embodiments are intended to be included within the scope of the appended claims.

That which is claimed is:

1. An antenna system comprising:

a base;

a turntable rotatably mounted on said base;

an elevation assembly carried on said turntable; and at least one antenna carried by said elevation assembly;

said turntable having an antenna relief opening therein receiving a lower portion of said at least one antenna when so positioned by said elevation assembly.

2. The antenna system according to claim 1 further comprising an RF absorbing shroud carried by said turntable and having an antenna receiving recess to receive said at least one antenna therein.

3. The antenna system according to claim 2 wherein the antenna receiving recess has lower portions extending into the antenna relief opening of said turntable.

4. The antenna system according to claim 2 wherein said RF absorbing shroud comprises a planar upper portion having the antenna receiving recess therein and at least one support leg depending therefrom to position the planar upper portion above said turntable a sufficient distance so that said at least one antenna remains below the planar upper portion.

5. The antenna system according to claim 2 further comprising a planar radome adjacent to said RF absorbing shroud.

6. The antenna system according to claim 1 wherein said at least one antenna has truncated upper and lower edge portions.

7. The antenna system according to claim 1 wherein said at least one antenna comprises at least one center feed reflector antenna.

8. The antenna system according to claim 1 wherein said elevation assembly comprises at least one elevation positioner operatively connected between said at least one antenna and said turntable; and wherein said turntable comprises at least one azimuth positioner operatively connected to said base.

9. The antenna system according to claim 8 further comprising a controller carried by the turntable and cooperating with said at least one elevation positioner and said at least one azimuth positioner.

10. An antenna system comprising:

a base;

a turntable rotatably mounted on said base;

an elevation assembly carried on said turntable;

at least one reflector antenna carried by said elevation assembly;

said turntable having an antenna relief opening therein; and an RF absorbing shroud carried by said turntable and having an antenna receiving recess extending into the antenna relief opening of said turntable.

11. The antenna system according to claim 10 wherein said RF absorbing shroud comprises a planar upper portion having the antenna receiving recess therein and at least one support leg depending therefrom to position the planar upper portion above said turntable a sufficient distance so that said at least one reflector antenna remains below the planar upper portion.

12. The antenna system according to claim 10 further comprising a planar radome adjacent to said RF absorbing shroud.

13. The antenna system according to claim 10 wherein said at least one reflector antenna has truncated upper and lower edge portions.

14. The antenna system according to claim 10 wherein said at least one reflector antenna comprises at least one center feed reflector antenna.

15. The antenna system according to claim 10 wherein said elevation assembly comprises at least one elevation positioner operatively connected between said at least one reflector antenna and said turntable; and wherein said turntable comprises at least one azimuth positioner operatively connected to said base.

16. The antenna system according to claim 15 further comprising a controller carried by the turntable and cooperating with said at least one elevation positioner and said at least one azimuth positioner.

17. A method for operating an antenna system comprising a base, a turntable rotatably mounted on the base, an elevation assembly carried on the turntable, at least one antenna carried by the elevation assembly, and with the turntable having an antenna relief opening therein, the method comprising:

operating the elevation assembly to position a lower portion of the at least one antenna in the antenna relief opening of the turntable.

18. The method according to claim 17 further comprising providing an RF absorbing shroud to be carried by the turntable and having an antenna receiving recess to receive the at least one antenna therein.

19. The method according to claim 18 the antenna receiving recess has lower portions extending into the antenna relief opening of the turntable.

20. The method according to claim 18 wherein the RF absorbing shroud comprises a planar upper portion having the antenna receiving recess therein and at least one support leg depending therefrom to position the planar upper portion above the turntable a sufficient distance so that the at least one antenna remains below the planar upper portion.

* * * * *